US007929871B2

(12) United States Patent
Takeda

(10) Patent No.: US 7,929,871 B2
(45) Date of Patent: Apr. 19, 2011

(54) IMAGE FORMING APPARATUS, IMAGE QUALITY MANAGEMENT METHOD AND IMAGE QUALITY MANAGEMENT PROGRAM

(75) Inventor: Kazuhisa Takeda, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 65 days.

(21) Appl. No.: 12/406,398

(22) Filed: Mar. 18, 2009

(65) Prior Publication Data

US 2009/0238584 A1 Sep. 24, 2009

Related U.S. Application Data

(60) Provisional application No. 61/037,561, filed on Mar. 18, 2008.

(51) Int. Cl.
*G03G 15/08* (2006.01)

(52) U.S. Cl. ..... 399/27

(58) Field of Classification Search ..... 399/9, 24, 399/25, 27–30, 110, 111, 119, 120
See application file for complete search history.

(56) References Cited

U.S. PATENT DOCUMENTS

| | | | | |
|---|---|---|---|---|
| 6,122,459 | A * | 9/2000 | Ogasawara | 399/27 |
| 7,113,711 | B2 * | 9/2006 | Okamura | 399/27 |
| 7,751,755 | B2 * | 7/2010 | Yamaguchi | 399/167 |
| 2002/0041770 | A1 * | 4/2002 | Nakazato et al. | 399/49 |
| 2004/0141765 | A1 * | 7/2004 | Shimura et al. | 399/49 |

* cited by examiner

*Primary Examiner* — Hoan Tran
(74) *Attorney, Agent, or Firm* — Turocy & Watson, LLP

(57) ABSTRACT

A technique is provided which enables keeping color developers of yellow, magenta and cyan in developing devices in a satisfactory state even in a circumstance where a black toner is mainly used, in an image forming apparatus which is capable of executing image quality maintenance control and the like and which carries out printing to a photoconductor, a belt and so on while stirring the developer of each color. A determination standard for determining whether the quantity of remaining developer in a developing device housing a developer of a color that is not black should be detected or not can be selected and set from plural kinds of determination standards. Information used for determination based on the set determination standard is acquired. On the basis of the set determination standard and the acquired information, the quantity of remaining developer in the developing device housing the developer of the color that is not black of the plural colors is detected.

23 Claims, 8 Drawing Sheets

IMAGE FORMING APPARATUS, IMAGE QUALITY MANAGEMENT METHOD AND IMAGE QUALITY MANAGEMENT PROGRAM

CROSS-REFERENCE TO RELATED APPLICATION

This application is based upon and claims the benefit of priority from U.S. provisional application 61/037,561, filed on Mar. 18, 2008, the entire contents of which are incorporated herein by reference.

TECHNICAL FIELD

The present invention relates to quality maintenance for a developer in an image forming apparatus, and particularly to a quality management technique for toner under conditions where monochrome toner is mainly used.

BACKGROUND

Conventionally, in an image forming apparatus, immediately after power is turned on or at the time of recovery from sleep state, image quality maintenance control and alignment control are executed in order to stabilize image quality. The image quality maintenance control and the alignment control consume toner of all the colors of yellow, magenta, cyan and black. Therefore, as the image quality maintenance control and the like is carried out many times, the quantity of toner in a developing device is reduced. Moreover, in the present status, toner is not supplied to the developing device when the image quality maintenance control and the alignment control are carried out.

For the conventional image forming apparatus, there are two mechanisms for supplying toner to the developing device, that is, (1) toner supply during ordinary printing and (2) toner supply when carrying out toner refreshing.

The toner refreshing is originally prepared for maintaining stabilization of image quality when carrying out image formation using color toner. Therefore, the startup of the toner refreshing is determined when the number of print sheets in the image formation using color toner exceeds a predetermined number of sheets. If it is determined that the print rate of at least one color of yellow, magenta, cyan and black is low, the toner refreshing is executed with respect to the developing devices of all the colors. In this case, toner is supplied to a developing device which is determined as having insufficient toner.

However, if the user only uses monochrome print, the quantity of remaining toner in the yellow, magenta and cyan developing devices is not grasped, though the quantity of remaining toner in the black developing device is monitored.

Thus, in the state of use where only monochrome print is mainly used, the toner refreshing is not executed and therefore the toner in the developing devices is reduced by the toner consumption due to the image quality maintenance control and the alignment control. Consequently, the image quality maintenance control and the alignment control cannot be carried out in some cases.

SUMMARY

An object of an embodiment of the invention is to provide a technique which enables keeping color developers of yellow, magenta and cyan in developing devices in a satisfactory state even in a circumstance where a black toner is mainly used, in an image forming apparatus which is capable of executing image quality maintenance control and the like and which carries out printing to a photoconductor, a belt and so on while stirring the developer of each color.

To solve the above problem, according to an aspect of the invention, an image forming apparatus capable of executing image formation using developers of plural colors including black, includes: a determination standard setting section which selects and sets, from plural kinds of determination standards, a determination standard for determining whether a quantity of remaining developer in a developing device housing a developer of a color that is not black should be detected or not; a standard information acquiring section which acquires information used for determination based on the determination standard set by the determination standard setting section; and a remaining quantity detection control section which causes the quantity of remaining developer in the developing device housing the developer of the color that is not black of the plural colors to be detected in accordance with the determination standard set by the determination standard setting section and the information acquired by the standard information acquiring section.

According to another aspect of the invention, an image quality management method for an image forming apparatus capable of executing image formation using developers of plural colors including black, includes: selecting and setting, from plural kinds of determination standards, a determination standard for determining whether a quantity of remaining developer in a developing device housing a developer of a color that is not black should be detected or not; acquiring information used for determination based on the set determination standard; and causing the quantity of remaining developer in the developing device housing the developer of the color that is not black of the plural colors to be detected in accordance with the set determination standard and the acquired information.

According to still another aspect of the invention, an image quality management program causes a computer to execute image quality management in an image forming apparatus capable of executing image formation using developers of plural colors including black. The program causes the computer to execute processing including: selecting and setting, from plural kinds of determination standards, a determination standard for determining whether a quantity of remaining developer in a developing device housing a developer of a color that is not black should be detected or not; acquiring information used for determination based on the set determination standard; and causing the quantity of remaining developer in the developing device housing the developer of the color that is not black of the plural colors to be detected in accordance with the set determination standard and the acquired information.

DETAILED DESCRIPTION

Hereinafter, embodiments of the invention will be described with reference to the drawings.

First Embodiment

First, a first embodiment of the invention will be described.

Figure 1:
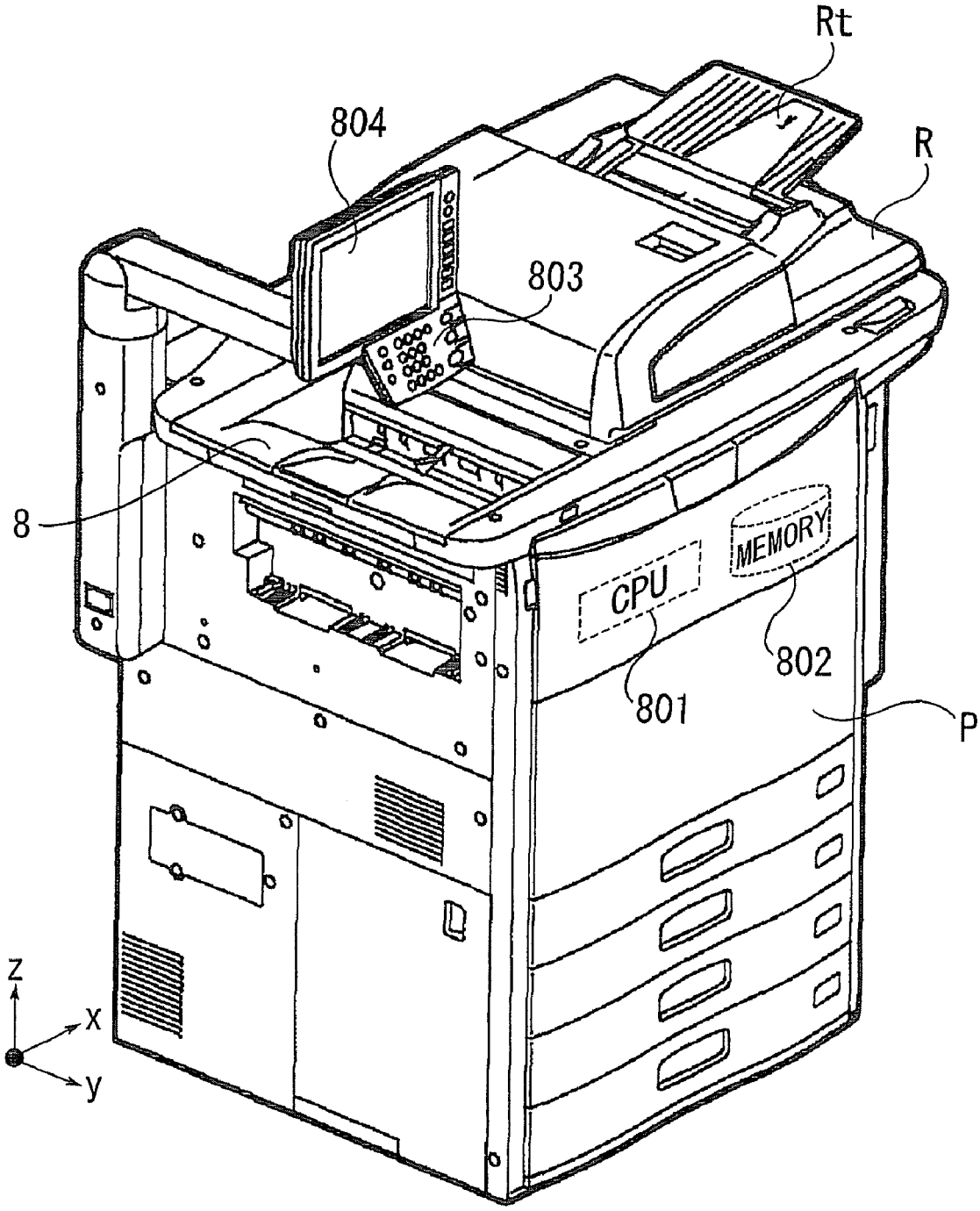
FIG. 1 is a perspective view showing the appearance of an image forming apparatus having an image quality management device according to a first embodiment of the invention.
Figure 2:
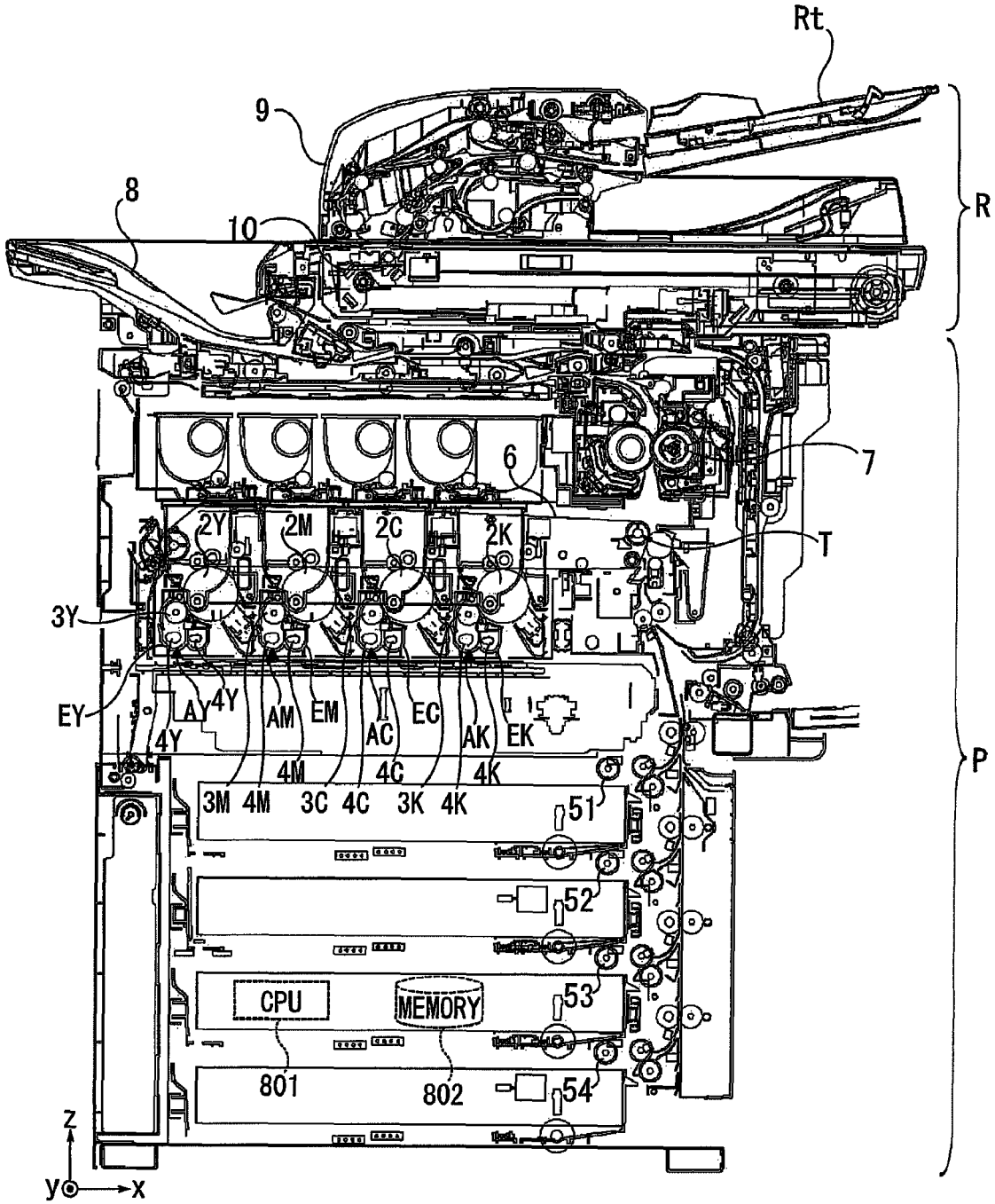
FIG. 2 is a longitudinal sectional view showing the schematic configuration of the image forming apparatus (multifunction peripheral or MFP) having the image quality management device according to the first embodiment of the invention.

FIG. 1 is a perspective view showing the appearance of an image forming apparatus having an image quality management device according to the first embodiment of the invention. FIG. 2 is a longitudinal sectional view showing the schematic configuration of the image forming apparatus (multi-function peripheral or MFP) having the image quality management device according to the first embodiment of the invention.

As shown in FIG. 1 and FIG. 2, the image forming apparatus according to this embodiment has an image scanning unit R and an image forming unit P.

The image scanning unit R has the function of scanning and reading an image of a sheet original and a book original.

The image forming unit P has the function of forming a developer image on a sheet on the basis of an image scanned from an original by the image scanning unit R or image data or the like transmitted to the image forming apparatus from an external device.

The image scanning unit R has an automatic document feeder (ADF) 9 capable of automatically carrying an original to a predetermined image scanning position. An image of an original which is automatically carried by this automatic document feeder 9 and set on an original tray (predetermined original setting stable) Rt or an original set on an original table, not shown, is scanned by a scanning optical system 10.

The image forming unit P has pickup rollers 51 to 54, photoconductors 2Y to 2K, developing rollers 3Y to 3K, mixers 4Y to 4K, an intermediate transfer belt 6, a fixing device 7, and a discharge tray 8.

The image forming apparatus according to this embodiment also has an operation input unit 803, a display unit 804, a CPU 801, and a memory 802 (see FIG. 1).

The CPU 801 is responsible for carrying out various processing in the image forming apparatus. The CPU 801 is also responsible for realizing various functions by executing a program stored in the memory 802. The memory 802 can include, for example, a RAM (random access memory), ROM (read only memory), DRAM (dynamic random access memory), SRAM (static random access memory), VRAM (video RAM) or the like. The memory 802 is responsible for storing various information and programs which are used in the image forming apparatus.

The display unit 804 can include, for example, an LCD (liquid crystal display), EL (electronic luminescence), PDP (plasma display panel), CRT (cathode ray tube) or the like.

The operation input unit 803 can include, for example, a keyboard, mouse, touch panel, touch pad, graphic tablet or the like.

Also, a so-called touch panel display can realize the functions of the display unit 804 and the operation input unit 803.

Hereinafter, the outline of copying will be described as an example of processing in the image forming apparatus according to this embodiment.

First, a sheet picked up by the pickup rollers 51 to 54 from a cassette is supplied into a sheet carrying path. The sheet supplied into the sheet carrying path is carried in a predetermined carrying direction by plural roller pairs.

Then, images of plural sheets of an original that is continuously and automatically carried by the automatic document feeder 9 are scanned by the scanning optical system 10 at a predetermined image scanning position.

Next, on the basis of image data of the images scanned from the original in the image scanning unit R, electrostatic latent images are formed on the photoconductive surfaces of the photoconductors 2Y, 2M, 2C and 2K for transferring yellow (Y), magenta (M), cyan (C) and black (K) developer images to a sheet.

Subsequently, the developers stirred by the mixers 4Y to 4K (equivalent to stirring units) in the developing devices are supplied by the developing rollers (so-called magnet rollers) 3Y to 3K to the photoconductors 2Y to 2K on which the electrostatic latent images are formed as described above. Thus, the electrostatic latent images formed on the photoconductive surfaces of the photoconductors are visualized.

The developer images thus formed on the photoconductors are transferred to the belt surface of the intermediate transfer belt 6 (so-called primary transfer). The developer images carried by the turning of the intermediate transfer belt are transferred onto the carried sheet at a predetermined secondary transfer position T.

The developer images transferred onto the sheet are fixed by heating to the sheet by the fixing device 7.

The sheet having the developer images fixed thereto by heating is carried through the carrying path by the plural carrying roller pairs and sequentially discharged onto the discharge tray 8.

Developing devices EY to EK having the developing rollers 3Y to 3K, the mixers 4Y to 4K and so on have permeability-type ATC sensors AY to AK for detecting the quantity of remaining toner housed in the developing devices. The ATC sensors AY to AK can detect the specific concentration of toner of the developer that is carried while being stirred by the mixers 4Y to 4K.

In the image forming apparatus according to this embodiment, "toner refreshing (developer refreshing)" is carried out in order to maintain the developers housed in the yellow, magenta and cyan developing devices EY, EM and EC in a satisfactory state.

Specifically, in the "toner refreshing" in this embodiment, when carrying out image formation using at least one of yellow, magenta and cyan, the states of concentration (indicator of the quantity of remaining toner) of the developers in the developing devices EY, EM and EC are detected by the ATC sensors AY, AM and AC, and if the quantity of developer is insufficient in any of these developing devices, the degraded developer is discharged in a predetermined pattern onto the photoconductive drum and fresh toner is supplied into the developing devices. Thus, the developers in the developing devices are maintained in a satisfactory state.

Moreover, in the image forming apparatus according to this embodiment, in order to maintain stability of its image quality, test printing is periodically carried out on the photoconductors or the transfer belt and the print is scanned. Thus, various image forming conditions are optimized (so-called image quality maintenance control).

Figure 3:
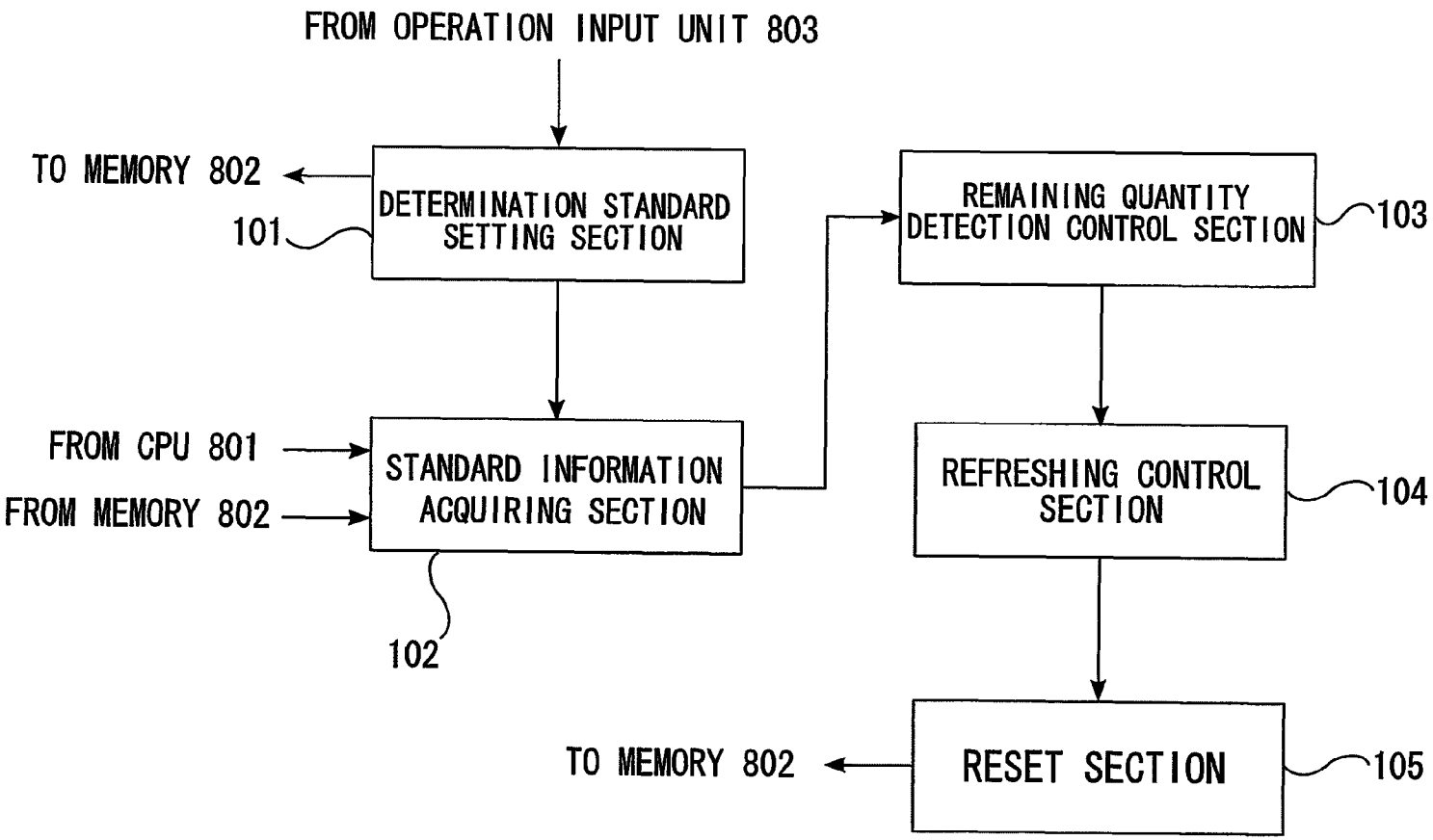
FIG. 3 is a functional block diagram for explaining the image forming apparatus having the image quality management device according to the first embodiment of the invention.

Now, the functions provided in the image quality management device according to this embodiment will be described in detail. FIG. 3 is a functional block diagram for explaining the image forming apparatus having the image quality management device according to the first embodiment of the invention.

The image quality management device according to this embodiment has a determination standard setting section 101, a standard information acquiring section 102, a remaining quantity detection control section 103, a refreshing control section 104, and a reset section 105.

Figure 4:
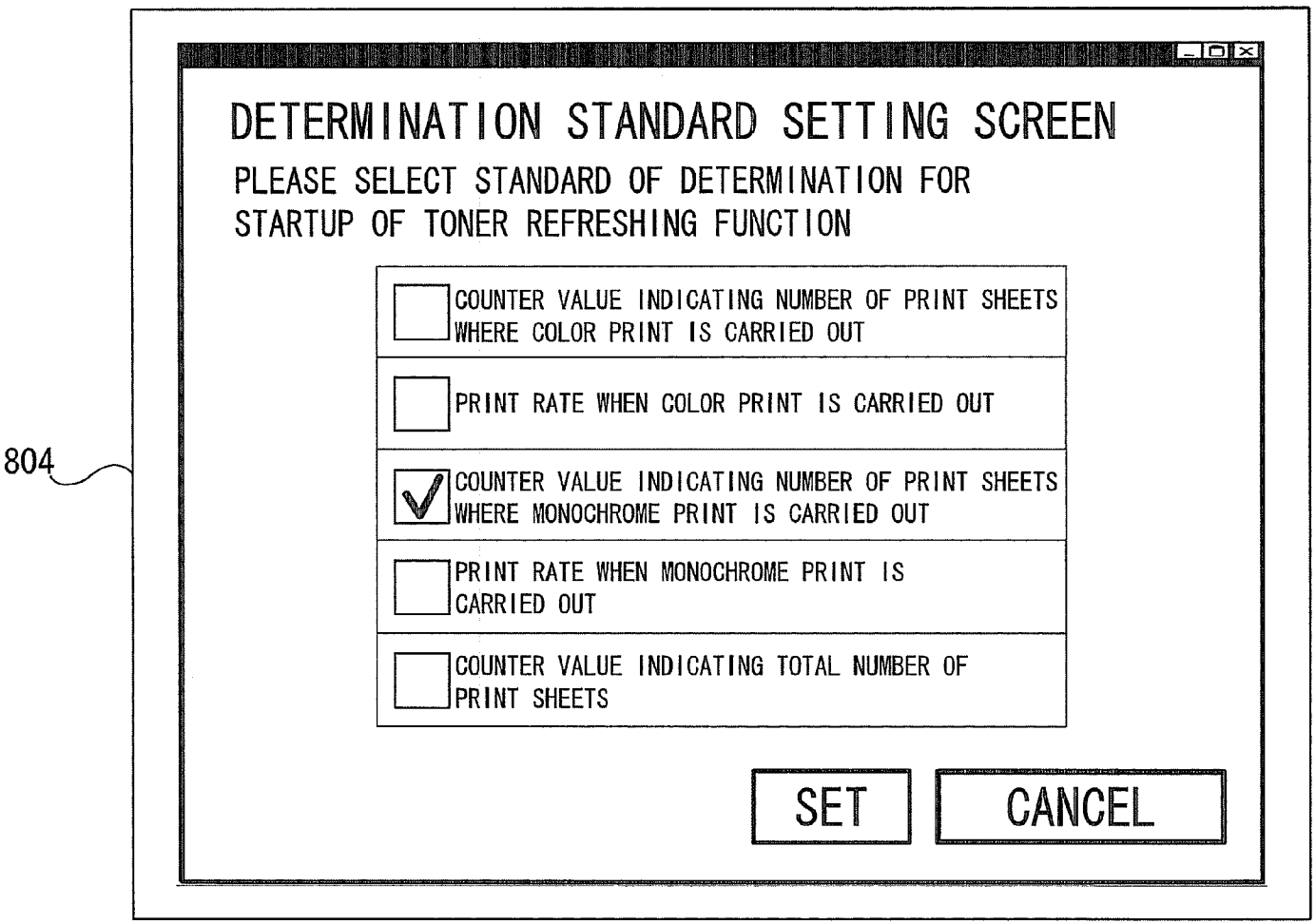
FIG. 4 shows an exemplary user interface screen displayed on the screen of a display unit 804 when setting a determination standard by a determination standard setting section 101.

FIG. 4 shows an exemplary user interface screen displayed on the screen of the display unit 804 when setting a determination standard by the determination standard setting section 101.

The determination standard setting section 101 selects and sets, from plural kinds of determination standards, a "determination standard" for determining whether the quantity of remaining developer in a developing device housing a developer of a color that is not black should be detected or not, in accordance with the input content accepted by the operation input unit 803. The setting of the determination standard by the determination standard setting section 101 can also be executed through the setting at the time of shipment from the plant or by a maintenance worker, instead of through the operation of the operation input unit 803.

Specifically, the determination standard setting section 101 can select and set, for example, at least one of the following as the "determination standard":

(1) the number of print sheets in image formation using the black developer;

(2) the print rate in image formation using the black developer;

(3) the number of print sheets in image formation using a developer of a color that is not black of the plural colors;

(4) the print rate in image formation using a developer of a color that is not black of the plural colors; and (5) the number of print sheets in image formation using a developer of at least one of the plural colors.

Of course, along with the selection and setting of the determination standard by the determination standard setting section 101, a threshold value to be compared with information used for determination may be arbitrarily set when carrying out determination based on the set determination standard.

The standard information acquiring section 102 acquires information used for determination based on the determination standard set by the determination standard setting section 101. Specifically, the information acquired by the standard information acquiring section 102 may include the counter value indicating the number of print sheets in image formation using the black developer, the print rate in image formation using the black developer, the counter value indicating the number of print sheets in image formation using a developer of a color that is not black of the plural colors, the print rate in image formation using a developer of a color that is not black of the plural colors, the counter value indicating the number of print sheets (total number of print sheets) in image formation using a developer of at least one of the plural colors, and so on. The counter values can be acquired, for example, from the CPU 801 or the like. The information acquired by the standard information acquiring section 102 is stored, for example, in the memory 802 or the like.

Of course, the standard information acquiring section 102 can also acquire, for example, information indicating "the number of times the image quality maintenance control is executed" or "time when the image quality maintenance control is executed", as information that can be used to estimate the state of degradation of the color developers.

The remaining quantity detection control section 103 causes the quantity of remaining developer in a developing device housing a developer of at least "a color that is not black of the plural colors" to be detected in accordance with the determination standard set by the determination standard setting section 101 and the information acquired by the standard information acquiring section 102.

Specifically, the remaining quantity detection control section 103 rotationally drives the mixer in the developing device which houses at least one of the yellow, magenta and cyan developers and causes the ATC sensor to detect the quantity of remaining developer.

With such a configuration, in principle, in the image forming apparatus configured to detect the quantity of remaining developer in the developing devices housing color developers only when image formation using the color developers is carried out, the state such as the quantity of remaining developer in all the developing devices for yellow, magenta, cyan and black can be confirmed even in a utilization environment where monochrome print is mainly carried out (color print is carried out less frequently). Thus, developers can be supplied according to the need. Therefore, in the image forming apparatus of the above configuration, for example, in a utilization mode where only monochrome print is carried out, high image quality can be maintained and developer supply can be realized as well.

The refreshing control section 104 causes "auxiliary refreshing" to be carried out if the quantity of remaining developer detected by the remaining quantity detection control section 103 is smaller than an allowable quantity.

The "auxiliary refreshing" in this case refers to processing to supply a new developer at least to a developing device for which it is determined that the quantity of remaining developer is smaller than the allowable quantity, while discharging the developer from the developing device.

In the image forming apparatus according to this embodiment, if the number of print sheets or print rate in image formation using at least one of the yellow, magenta and cyan developers (colors that are not black, of the plural colors) exceeds a predetermined value, the "toner refreshing" is executed in the developing devices housing the yellow, magenta and cyan developers.

The refreshing control section 104 causes the "auxiliary refreshing" to be carried out with a smaller quantity of developer consumption than the quantity of developer consumption used in the above toner refreshing.

Figure 5:
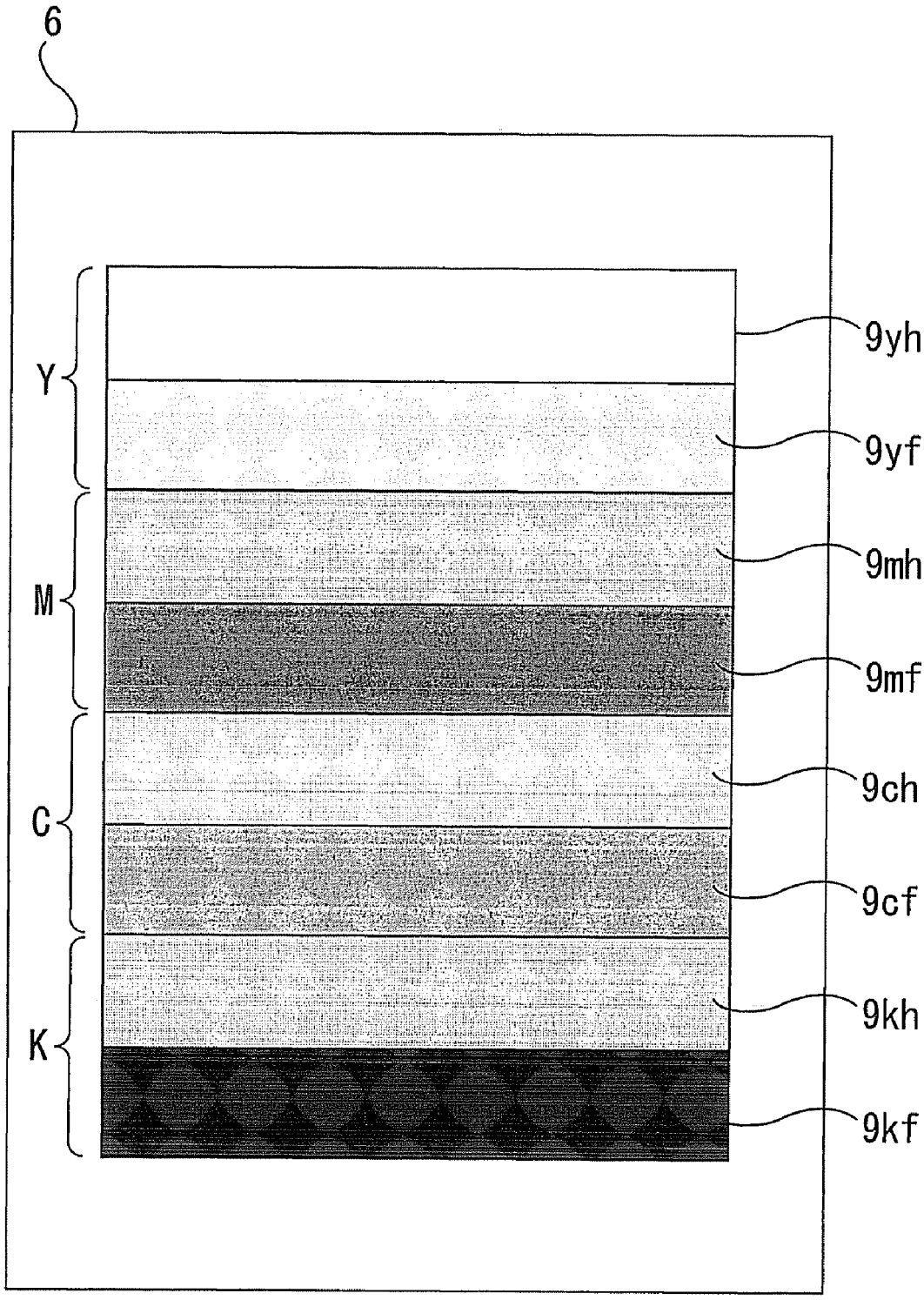
FIG. 5 shows an exemplary predetermined pattern formed on a belt 6 in ordinary toner refreshing.

FIG. 5 shows an exemplary predetermined pattern formed on the belt 6 in ordinary toner refreshing. In FIG. 5, it can be seen that halftone images 9*yh* to 9*kh* and solid images 9*yf* to 9*kf* are formed on the belt 6 for the yellow, magenta, cyan and black developers, respectively.

Figure 6:
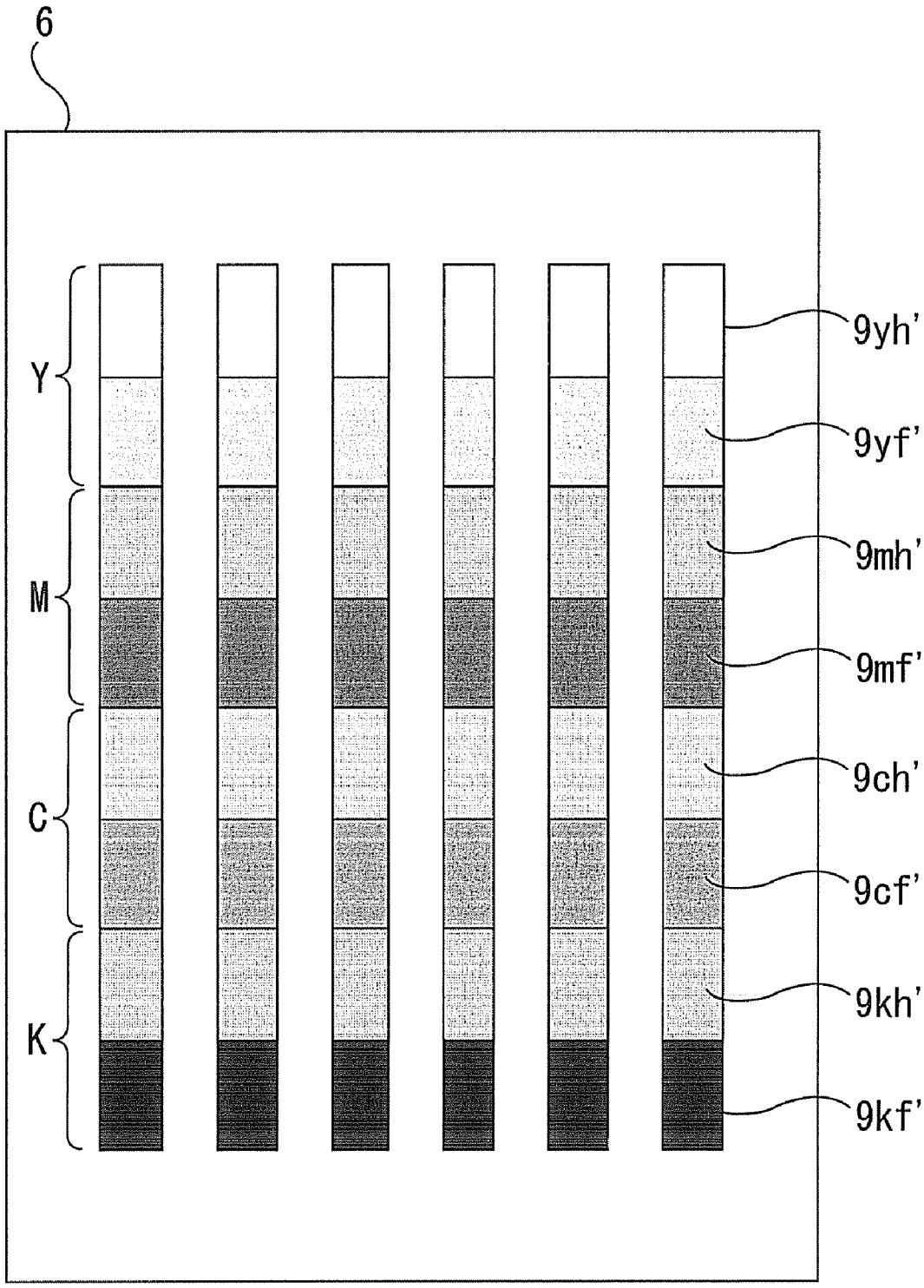
FIG. 6 shows an exemplary predetermined pattern formed on the belt 6 in auxiliary refreshing.

FIG. 6 shows an exemplary predetermined pattern formed on the belt 6 in the auxiliary refreshing. As shown in FIG. 6, in the auxiliary refreshing, the area of the predetermined pattern formed on the belt is set, for example, to 50% of the area of the predetermined pattern formed on the belt in the ordinary toner refreshing. In FIG. 6, it can be seen that halftone images 9*yh*' to 9*kh*' and solid images 9*yf*' to 9*kf*' are formed on the belt 6 for the yellow, magenta, cyan and black developers, respectively. Thus, it is possible to grasp the state of the developers in the developing devices and improve the quality of the degraded developers in the developing devices while restraining the consumption of the developers to the minimum level. The reflectance or the like of the patterns shown in FIG. 5 and FIG. 6 is scanned by an optical sensor or the like, not shown.

The reset section 105 resets the value of the information acquired by the standard information acquiring section 102 when the auxiliary refreshing is completed.

Figure 7:
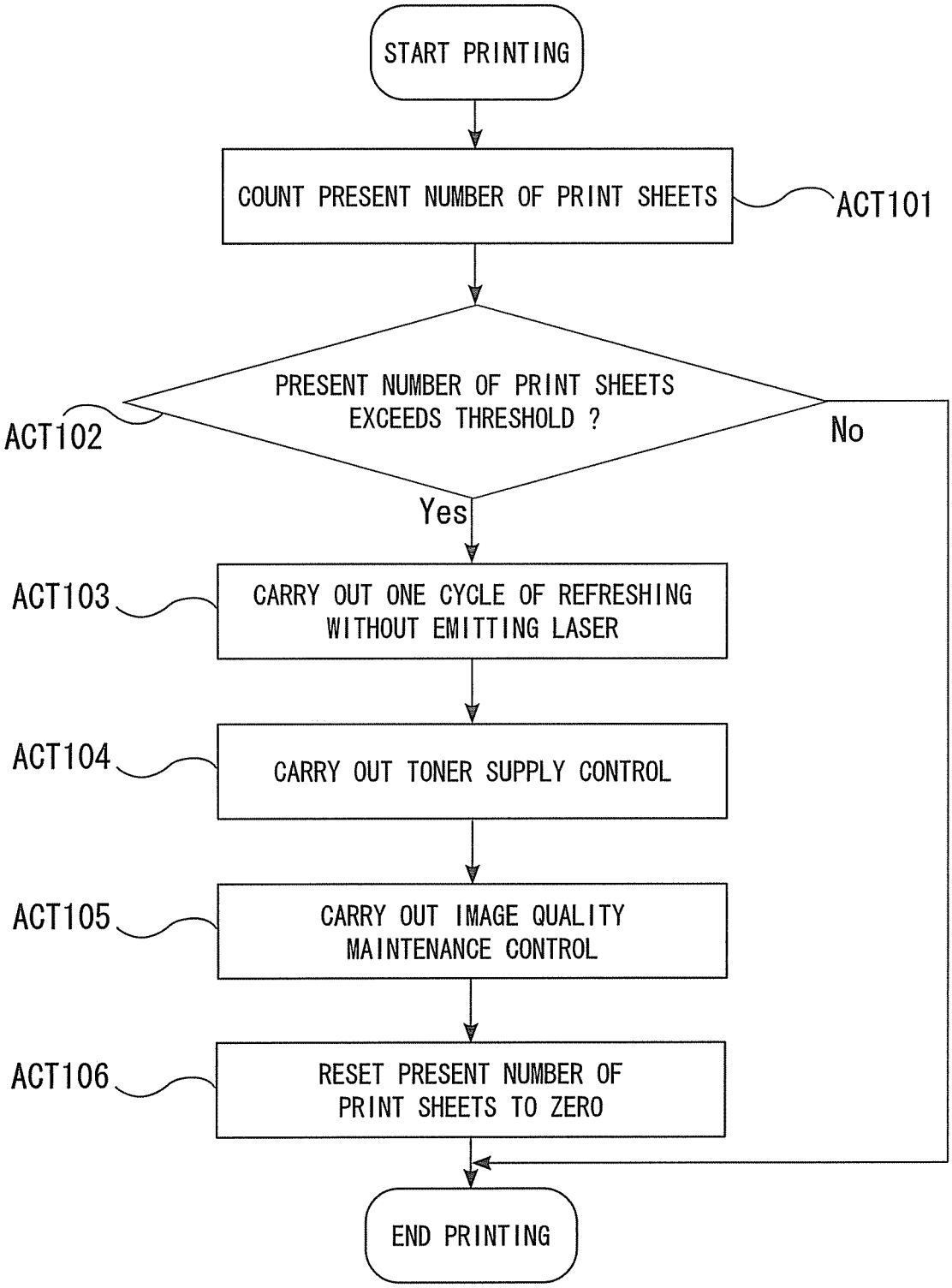
FIG. 7 is a flowchart for explaining the flow of processing (image quality management method) in the image forming apparatus having the image quality management device according to the first embodiment of the invention.

FIG. 7 is a flowchart for explaining the flow of processing (image quality management method) in the image forming apparatus having the image quality management device according to the first embodiment of the invention.

Here, it is assumed that the selection and setting of a "determination standard" for determining whether the quantity of remaining developer in a developing device housing a developer of a color that is not black should be detected or not, by the determination standard setting section 101 in accordance with the input content accepted by the operation input unit 803, is completed in advance. Moreover, the set value by the determination standard setting section 101 can be stored, for example, in the memory 802 or the like.

As printing is started, the standard information acquiring section 102 counts the present number of print sheets in image formation using the black developer (ACT 101). At this point, for example, the CPU 801 may compare the print counter value at the end of printing with a "toner refreshing setting value (predetermined value)".

If it is determined by the CPU 801 that the print counter exceeds the "toner refreshing setting value" (Yes in ACT 102), the operation shifts to toner refreshing. On the other hand, if it is determined that the print counter does not exceed the "toner refreshing setting value" No in ACT 102), the ready state is maintained.

Subsequently, the CPU 801 abuts the belt 6 to the developing devices EY to EK and thus enables image formation using the yellow, magenta, cyan and black developers.

Next, if the number of print sheets acquired by the standard information acquiring section 102 exceeds a predetermined threshold value, the remaining quantity detection control section 103 rotationally drives the mixers of the developing devices without casting laser beams to the photoconductive drums, and thus causes one cycle of refreshing (equivalent to "auxiliary refreshing") to be executed (ACT 103), in order to grasp the quantity of remaining developer in the developing devices EY to EK housing the yellow, magenta, cyan and black developers.

Thus, the remaining quantity detection control section 103 causes the quantity of remaining developers in the developing devices housing the developers of the color that are not black, of the plural colors, to be detected.

The refreshing control section 104 causes developer supply to be executed according to the required quantity of developer supply (equivalent to "auxiliary refreshing") if the quantity of remaining developer detected by the remaining quantity detection control section 103 is smaller than an allowable quantity (ACT 104). If the quantity of remaining developer detected by the remaining quantity detection control section 103 exceeds the allowable quantity (that is, if the supply level is not reached), no developer is supplied.

Next, the CPU 801 executes "image quality maintenance control" in order to secure stability of image quality because the specific concentration of the developers in the developing devices (specific concentration of toner) may change as a result of supplying the developers and therefore the image density may vary (ACT 105).

After the above processing, the reset section 105 resets the number of print sheets counter (ACT 106).

Of course, in this embodiment, if the number of print sheets in image formation using a developer of a color that is not black of the plural colors is set as a determination standard by the determination standard setting section 101, detection of the quantity of remaining developer in the developing device housing color toner is executed in accordance with the quantity of color toner consumption. That is, "toner refreshing" can be executed with a conventional algorithm.

Second Embodiment

Now, a second embodiment of the invention will be described.

Figure 8:
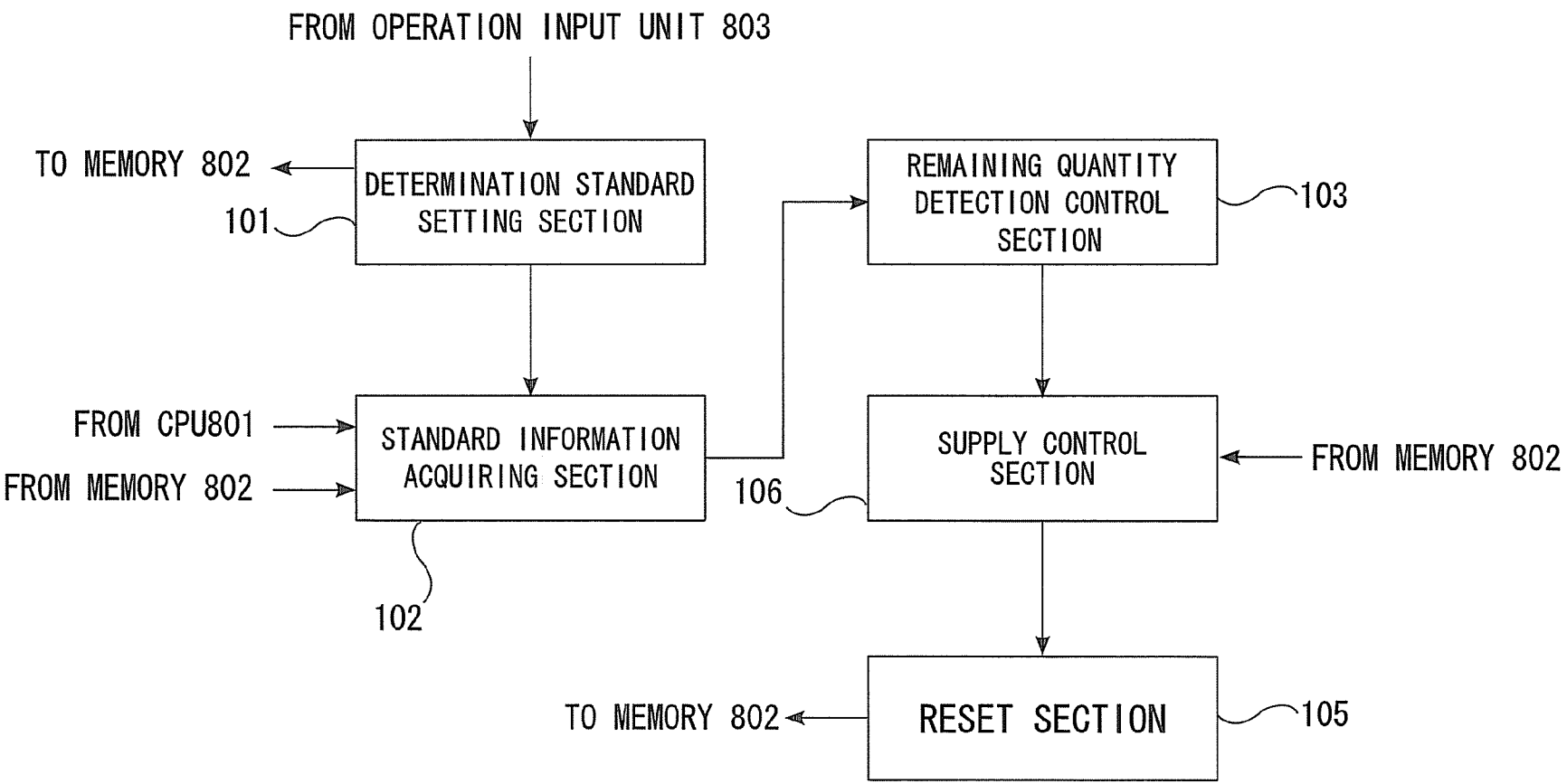
FIG. 8 is a functional block diagram showing the functions of a quality management device according to a second embodiment of the invention.

FIG. 8 is a functional block diagram showing the functions of a quality management device according to the second embodiment of the invention.

The second embodiment of the invention is a modification of the first embodiment. Hereinafter, components having the same functions as those already described in the first embodiment are denoted by the same reference numerals and will not be described further in detail.

If the quantity of remaining developer detected by the remaining quantity detection control section 103 is smaller than an allowable quantity, a supply control section 106 in this embodiment causes "developer supply" to be carried out in which a new developer is supplied at least into a developing device for which it is determined that the quantity of remaining developer is smaller than the allowable quantity.

In this manner, as emission of laser beams to the photoconductive drums is perfectly stopped when executing the developer refreshing, developer supply can be carried out while the quantity of developer consumption is restrained to the minimum level.

Each operation in the above processing (image quality management method) in the image forming apparatus having the image quality management device is realized by causing the CPU 801 to execute the image quality management program stored in the memory 802.

Moreover, a program which causes a computer constituting the image quality management device to execute each of the above acts can be provided as the image quality management program. In this embodiment, an example is described in which the program to realize the functions carrying out the invention is recorded in advance in the storage area provided within the apparatus. However, the program is not limited to this form. A similar program may be downloaded to the apparatus from a network or a similar program stored in a computer-readable recording medium can be installed in the apparatus. The recording medium may be in any form that can store a program and can be read by a computer. Specifically, such recording media may include, for example, internal storage devices arranged within a computer such as ROM and RAM, portable storage media such as CD-ROM, flexible disk, DVD disk, magneto-optical disk and IC card, a data base which holds computer programs, another computer and its database, and a transmission medium on a network line. The functions that can be acquired in advance by installation and downloading may be realized in cooperation with the OS (operating system) in the apparatus.

The program according to this embodiment includes a program for which an execution module is dynamically generated.

Although the invention is described with reference to specific embodiments, it will be obvious to those skilled in the art that various changes and modification can be made without departing from the spirit and scope of the invention.

As described above in detail, according to the invention, a technique can be provided which enables keeping color developers of yellow, magenta and cyan in developing devices in a satisfactory state even in a circumstance where a black toner is mainly used, in an image forming apparatus which is capable of executing image quality maintenance control and the like and which carries out printing to a photoconductor, a belt and so on while stirring the developer of each color.

What is claimed is:

1. An image forming apparatus capable of executing image formation using developers of plural colors including black, comprising:

a determination standard setting section which selects and sets, from plural kinds of determination standards, a determination standard for determining whether it is timing when a quantity of remaining developer in a developing device housing a developer of a color that is not black should be detected or not;

a standard information acquiring section which acquires information used for determination based on the determination standard set by the determination standard setting section; and a remaining quantity detection control section which causes the quantity of remaining developer in the developing device housing the developer of the color that is not black of the plural colors to be detected in accordance with the determination standard set by the determination standard setting section and the information acquired by the standard information acquiring section.

2. The apparatus according to claim 1, wherein the determination standard setting section is capable of selecting and setting, as the determination standard, at least one of the number of print sheets in image formation using the black developer, a print rate in image formation using the black developer, the number of print sheets in image formation using the developer of the color that is not black of the plural colors, and a print rate in image formation using the developer of the color that is not black of the plural colors.

3. The apparatus according to claim 1, wherein the determination standard setting section is capable of selecting and setting, as the determination standard, the number of print sheets in image formation using a developer of at least one of the plural colors, the standard information acquiring section acquires the number of print sheets in image formation using the developer of at least one of the plural colors, and the remaining quantity detection control section causes the quantity of remaining developer in the developing device housing the developer of the color that is not black of the plural colors to be detected if the number of print sheets acquired by the standard information acquiring section exceeds a predetermined threshold value.

4. The apparatus according to claim 1, further comprising a refreshing control section which, if the quantity of remaining developer caused to be detected by the remaining quantity detection control section is smaller than an allowable quantity, causes auxiliary refreshing to be carried out to supply a new developer at least into a developing device for which it is determined that the quantity of remaining developer is smaller than the allowable quantity while discharging the developer in the developing device.

5. The apparatus according to claim 4, wherein if the number of print sheets or print rate in image formation carried out by using the developer of the color that is not black of the plural colors exceeds a predetermined value, the image forming apparatus causes developer refreshing to be carried out to supply a new developer into the developing device housing the developer of the color that is not black of the plural colors while discharging the developer in the developing device, and the refreshing control section causes the auxiliary refreshing to be carried out with a smaller quantity of developer consumption than a quantity of developer consumption in the developer refreshing.

6. The apparatus according to claim 4, further comprising a reset section which resets a value of the information acquired by the standard information acquiring section when the auxiliary refreshing is completed.

7. The apparatus according to claim 1, wherein the image forming apparatus visualizes, by using the developer, an electrostatic latent image formed on a photoconductor by casting a laser beam thereto, the apparatus further comprising a supply control section which, if the quantity of remaining developer caused to be detected by the remaining quantity detection control section is smaller than an allowable quantity, causes developer supply to be carried out to supply a new developer at least into a developing device for which it is determined that the quantity of remaining developer is smaller than the allowable quantity.

8. An image quality management method for an image forming apparatus capable of executing image formation using developers of plural colors including black, comprising:

selecting and setting, from plural kinds of determination standards, a determination standard for determining whether a quantity of remaining developer in a developing device housing a developer of a color that is not black should be detected or not;

acquiring information used for determination based on the set determination standard; and causing the quantity of remaining developer in the developing device housing the developer of the color that is not black of the plural colors to be detected in accordance with the set determination standard and the acquired information.

9. The method according to claim 8, wherein at least one of the number of print sheets in image formation using the black developer, a print rate in image formation using the black developer, the number of print sheets in image formation using the developer of the color that is not black of the plural colors, and a print rate in image formation using the developer of the color that is not black of the plural colors can be selected and set as the determination standard.

10. The method according to claim 8, wherein the number of print sheets in image formation using a developer of at least one of the plural colors can be selected and set as the determination standard, the number of print sheets in image formation using the developer of at least one of the plural colors is acquired as the information used for determination based on the determination standard, and the quantity of remaining developer in the developing device housing the developer of the color that is not black of the plural colors is detected if the acquired number of print sheets exceeds a predetermined threshold value.

11. The method according to claim 8, wherein if the detected quantity of remaining developer is smaller than an allowable quantity, auxiliary refreshing is carried out to supply a new developer at least into a developing device for which it is determined that the quantity of remaining developer is smaller than the allowable quantity while discharging the developer in the developing device.

12. The method according to claim 11, wherein if the number of print sheets or print rate in image formation carried out by using the developer of the color that is not black of the plural colors exceeds a predetermined value, developer refreshing is carried out to supply a new developer into the developing device housing the developer of the color that is not black of the plural colors while discharging the developer in the developing device, and the auxiliary refreshing is carried out with a smaller quantity of developer consumption than a quantity of developer consumption in the developer refreshing.

13. The method according to claim 11, wherein a value of the information acquired as the information used for determination based on the determination standard is reset when the auxiliary refreshing is completed.

14. The method according to claim 8, wherein the image forming apparatus visualizes, by using the developer, an electrostatic latent image formed on a photoconductor by casting a laser beam thereto, and if the detected quantity of remaining developer is smaller than an allowable quantity, developer supply is carried out to supply a new developer at least into a developing device for which it is determined that the quantity of remaining developer is smaller than the allowable quantity.

15. An image quality management program stored on a computer readable medium causing a computer to execute image quality management in an image forming apparatus capable of executing image formation using developers of plural colors including black, the program causing the computer to execute processing comprising:

selecting and setting, from plural kinds of determination standards, a determination standard for determining whether a quantity of remaining developer in a developing device housing a developer of a color that is not black should be detected or not;

acquiring information used for determination based on the set determination standard; and causing the quantity of remaining developer in the developing device housing the developer of the color that is not black of the plural colors to be detected in accordance with the set determination standard and the acquired information.

16. The program according to claim 15, wherein at least one of the number of print sheets in image formation using the black developer, a print rate in image formation using the black developer, the number of print sheets in image formation using the developer of the color that is not black of the plural colors, and a print rate in image formation using the developer of the color that is not black of the plural colors can be selected and set as the determination standard.

17. The program according to claim 15, wherein the number of print sheets in image formation using a developer of at least one of the plural colors can be selected and set as the determination standard, and the computer is caused to execute processing in which the number of print sheets in image formation using the developer of at least one of the plural colors is acquired as the information used for determination based on the determination standard, and detecting the quantity of remaining developer in the developing device housing the developer of the color that is not black of the plural colors if the acquired number of print sheets exceeds a predetermined threshold value.

18. The program according to claim 15, wherein the computer is caused to execute processing in which if the detected quantity of remaining developer is smaller than an allowable quantity, auxiliary refreshing is carried out to supply a new developer at least into a developing device for which it is determined that the quantity of remaining developer is smaller than the allowable quantity while discharging the developer in the developing device.

19. The program according to claim 18, wherein if the number of print sheets or print rate in image formation carried out by using the developer of the color that is not black of the plural colors exceeds a predetermined value, developer refreshing is carried out to supply a new developer into the developing device housing the developer of the color that is not black of the plural colors while discharging the developer in the developing device, and the computer is caused to execute processing in which the auxiliary refreshing is carried out with a smaller quantity of developer consumption than a quantity of developer consumption in the developer refreshing.

20. The program according to claim 15, wherein the image forming apparatus visualizes, by using the developer, an electrostatic latent image formed on a photoconductor by casting a laser beam thereto, and the computer is caused to execute processing in which if the detected quantity of remaining developer is smaller than an allowable quantity, developer supply is carried out to supply a new developer at least into a developing device for which it is determined that the quantity of remaining developer is smaller than the allowable quantity.

21. An image forming apparatus capable of executing image formation using developers of plural colors including black, comprising:

a determination standard setting section which selects and sets, from plural kinds of determination standards, a determination standard for determining whether it is timing when a quantity of remaining developer in a developing device housing a developer of either of the plural colors should be detected or not;

a standard information acquiring section which acquires information used for determination based on the determination standard set by the determination standard setting section; and a remaining quantity detection control section which causes the quantity of remaining developer in the developing device housing the developer of the same color as either of the plural colors to be detected in accordance with the determination standard set by the determination standard setting section and the information acquired by the standard information acquiring section.

22. An image quality management method for an image forming apparatus capable of executing image formation using developers of plural colors including black, comprising:

selecting and setting, from plural kinds of determination standards, a determination standard for determining whether a quantity of remaining developer in a developing device housing a developer of either of the plural colors should be detected or not;

acquiring information used for determination based on the set determination standard; and causing the quantity of remaining developer in the developing device housing the developer of the same color as either of the plural colors to be detected in accordance with the set determination standard and the acquired information.

23. An image quality management program stored on a computer readable medium causing a computer to execute image quality management in an image forming apparatus capable of executing image formation using developers of plural colors including black, the program causing the computer to execute processing comprising:

selecting and setting, from plural kinds of determination standards, a determination standard for determining whether a quantity of remaining developer in a developing device housing a developer of either of the plural colors should be detected or not;

acquiring information used for determination based on the set determination standard; and causing the quantity of remaining developer in the developing device housing the developer of the same color as either of the plural colors to be detected in accordance with the set determination standard and the acquired information.

* * * * *